US005535729A

United States Patent [19]

Griffin et al.

[11] Patent Number: 5,535,729

[45] Date of Patent: Jul. 16, 1996

[54] PROJECTILE LAUNCHER

[75] Inventors: David R. Griffin, Morning View, Ky.; Ronald C. Boyle, Amelia, Ohio

[73] Assignee: Hasbro, Inc., Pawtucket, R.I.

[21] Appl. No.: 432,381

[22] Filed: May 1, 1995

[51] Int. Cl.[6] ..... F41B 11/00; F41B 11/02

[52] U.S. Cl. ..... 124/66; 124/65; 124/64; 124/59; 124/72; 124/48

[58] Field of Search ..... 124/59, 66, 67, 124/65, 72, 56, 64, 45, 48, 57

[56] References Cited

U.S. PATENT DOCUMENTS

| | | | |
|---|---|---|---|
| 2,237,678 | 4/1941 | Lohr et al. . | |
| 2,609,811 | 9/1952 | Lawrence | 124/48 |
| 2,922,412 | 1/1960 | Hosbach, Jr. . | |
| 3,009,453 | 11/1961 | Ayala | 124/48 X |
| 3,726,266 | 4/1973 | Palmer . | |
| 4,004,566 | 1/1977 | Fischer . | |
| 4,732,136 | 3/1988 | Ferri | 124/67 |
| 4,819,609 | 4/1989 | Tippmann . | |
| 4,841,655 | 6/1989 | Ferri . | |
| 4,848,307 | 7/1989 | Tsao . | |
| 4,850,328 | 7/1989 | Sindel . | |
| 4,881,517 | 11/1989 | Wackrow et al. | 124/56 X |
| 5,186,156 | 2/1993 | Clayton . | |
| 5,267,549 | 12/1993 | Webber . | |
| 5,415,152 | 5/1995 | Adamson et al. | 124/48 X |

*Primary Examiner*—Randolph A. Reese
*Assistant Examiner*—Thomas A. Beach
*Attorney, Agent, or Firm*—Kurt R. Benson

[57] ABSTRACT

A projectile launcher includes a launcher body having a nonrotatable projectile magazine thereon, a piston and cylinder assembly in the launcher body, and a lever operated actuating mechanism on the launcher body. The actuating mechanism is operative for loading and releasing the piston in the cylinder for producing individual blasts of compressed air and also for rotating the cylinder so that sequential blasts of compressed air are delivered to sequential launching chambers on the magazine in order to launch sequential projectiles therefrom.

6 Claims, 9 Drawing Sheets

PROJECTILE LAUNCHER

BACKGROUND AND SUMMARY OF THE INVENTION

The instant invention relates to projectile launchers and more particularly to a lever action projectile launcher which is operative for delivering blasts of compressed air to sequential launching chambers of a stationary magazine in order to launch sequential projectiles therefrom.

It has generally been found that projectile launchers which are adapted for launching relatively soft safe foam projectiles by delivering blasts of compressed air thereto have high levels of appeal. In this regard, projectile launchers of this type have generally been found to be relatively safe because they are generally adapted for launching relatively soft safe foam projectiles at relatively low velocities. Further, projectile launchers which are capable of sequentially launching several projectiles without reloading have been found to have even greater levels of appeal. However, most of the heretofore available projectile launchers of this type have included magazines which are rotatable for positioning sequential projectiles at a predetermined launching station. Further, the heretofore available projectile launching apparatus of this type have required relatively complex indexing mechanisms for rotating the magazines thereof in stepped increments in order to position sequential projectiles at a launching station.

The instant invention provides a new and relatively simple projectile launcher which is adapted for launching a plurality of sequential projectiles from a stationary launching station. In this regard, instead of including a magazine which is rotatable for receiving blasts of compressed air in sequential launching chambers thereof, the projectile launcher of the instant invention includes a rotatable piston and cylinder assembly which is rotatable in stepwise increments for communicating with sequential launching chambers of a stationary projectile magazine. Accordingly, the projectile launching apparatus of the instant invention is substantially simpler in its overall operation than the heretofore available air powered projectile launching devices which have been operative for launching several projectiles from a single magazine without reloading.

More specifically, the projectile launching apparatus of the instant invention comprises a launcher body having a magazine thereon which includes a plurality of forwardly directed launching chambers. Each of the launching chambers includes an air inlet, and each is adapted for receiving a projectile thereon so that the projectile is launchable from the launching chamber thereof by delivering a blast of compressed air thereto. The air inlets of the magazine are disposed in substantially uniformly spaced relation in a substantially circular array, and the launcher further includes a piston and cylinder assembly which is axially rotatable in the launcher body. The piston and cylinder assembly includes an air outlet which is spaced outwardly from the axis of rotation thereof and which is positioned so that it is receivable in aligned relation with sequential air inlets in the magazine as the piston and cylinder assembly is rotated in stepped increments. The projectile launcher further includes an operating mechanism for operating the piston and cylinder assembly to produce individual blasts of compressed air and for also rotating the piston and cylinder assembly in stepped increments so that the air outlet thereof is positioned in communication with sequential air inlets on the magazine during sequential blasts of compressed air. The magazine is preferably mounted in a stationary nonrotatable position on the launcher body, and the operating means preferably includes a rearwardly pivotable manually operable lever for reciprocating the piston and rotating the cylinder in stepped increments. The operating mechanism preferably includes a cam slot on the cylinder and a cam finger for engaging the cam slot in order to rotate the cylinder in stepped increments in the launcher body.

It has been found that the projectile launcher of the instant invention has significant advantages over the heretofore available projectile launchers. In this regard, because the projectile launcher of the instant invention includes a nonrotatable magazine and a rotatable piston and cylinder assembly rather than a rotatable magazine and a nonrotatable piston and cylinder assembly, the projectile launcher is operative with a substantially simpler overall operating mechanism than the heretofore available projectile launchers. Further, because the projectile launcher is operative with a lever action, it is possible for a user to quickly and easily operate the piston and cylinder assembly in order to rapidly launch a plurality of sequential projectiles from the magazine.

Accordingly, it is a primary object of the instant invention to provide an effective new launcher mechanism for launching a plurality of projectiles from a magazine of a projectile launcher without reloading the launcher.

Another object of the instant invention is to provide a projectile launcher having a stationary projectile magazine which is adapted for receiving a plurality of projectiles thereon.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
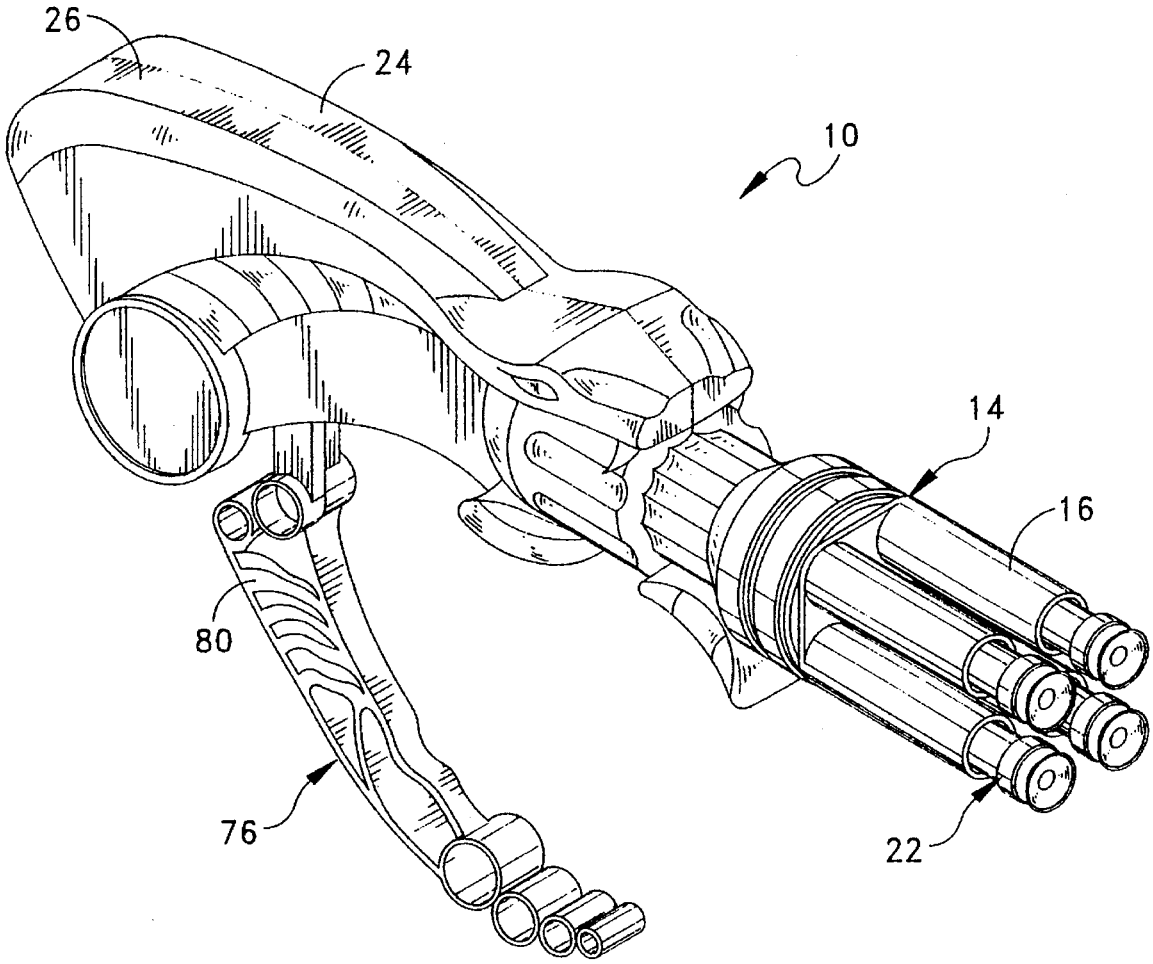
FIG. 1 is a perspective view of the projectile launcher of the instant invention.
Figure 2:
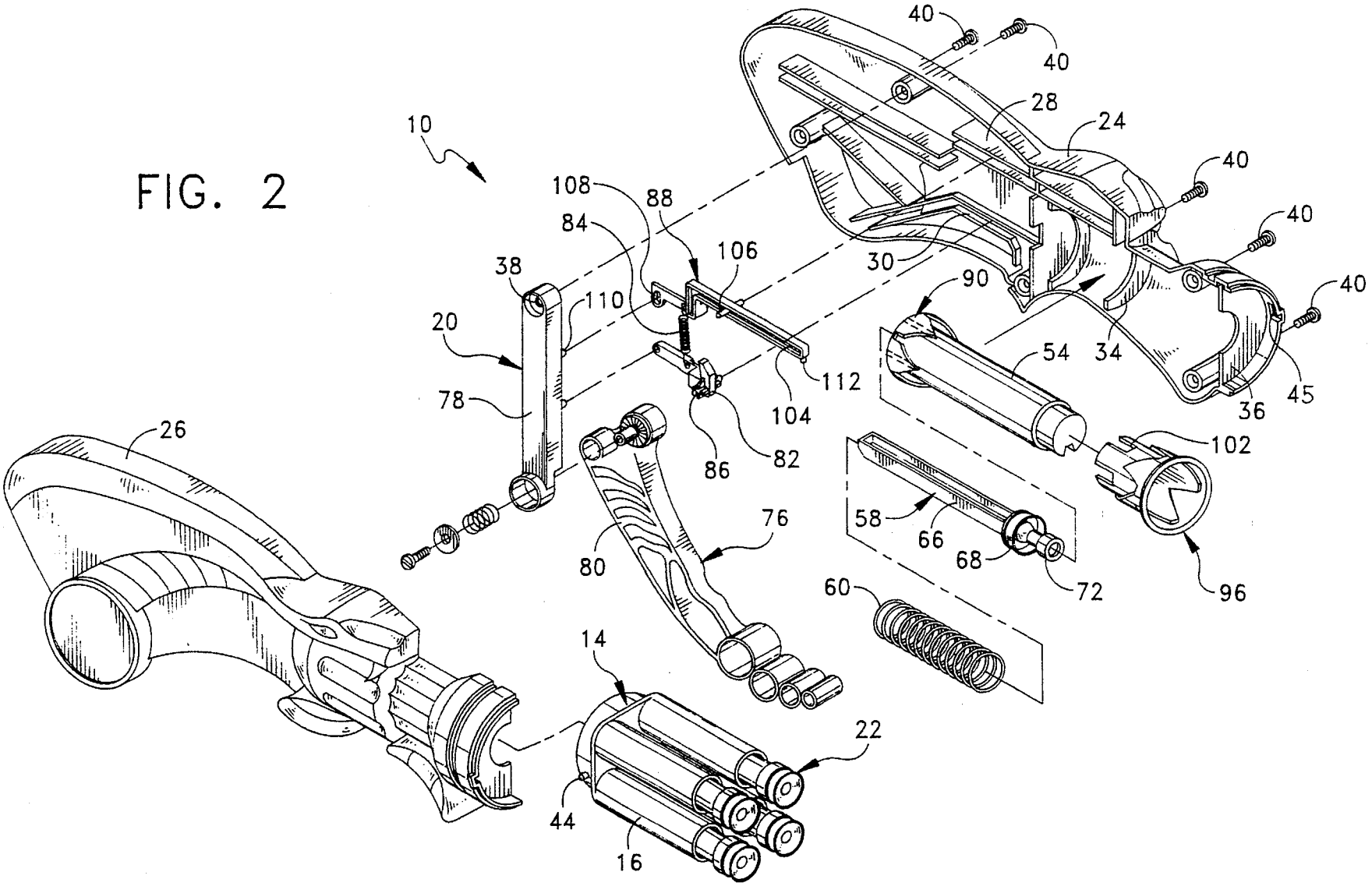
FIG. 2 is an exploded perspective view thereof.
Figure 3:
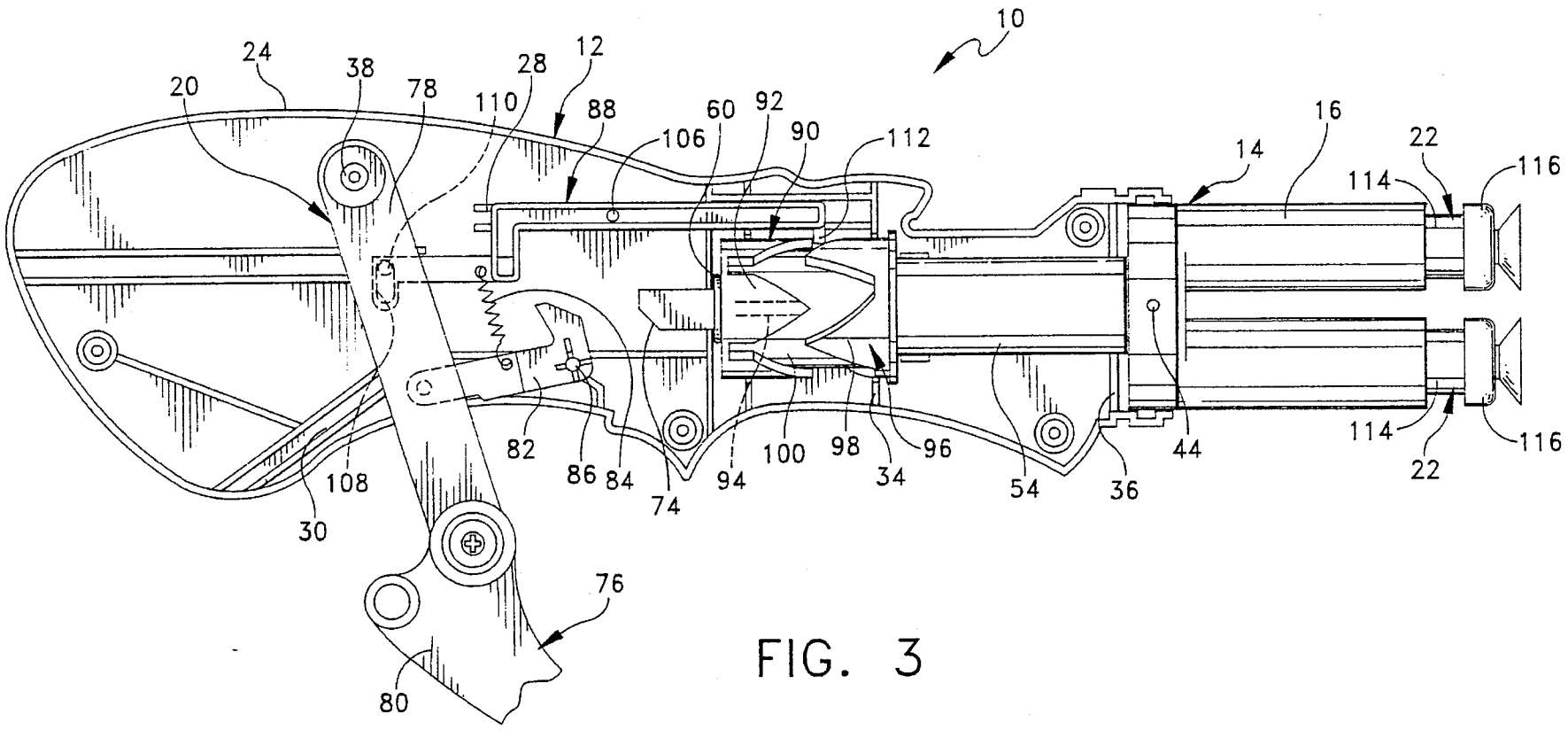
FIG. 3 is a fragmentary side elevational view thereof with the right housing section removed.
Figure 4:
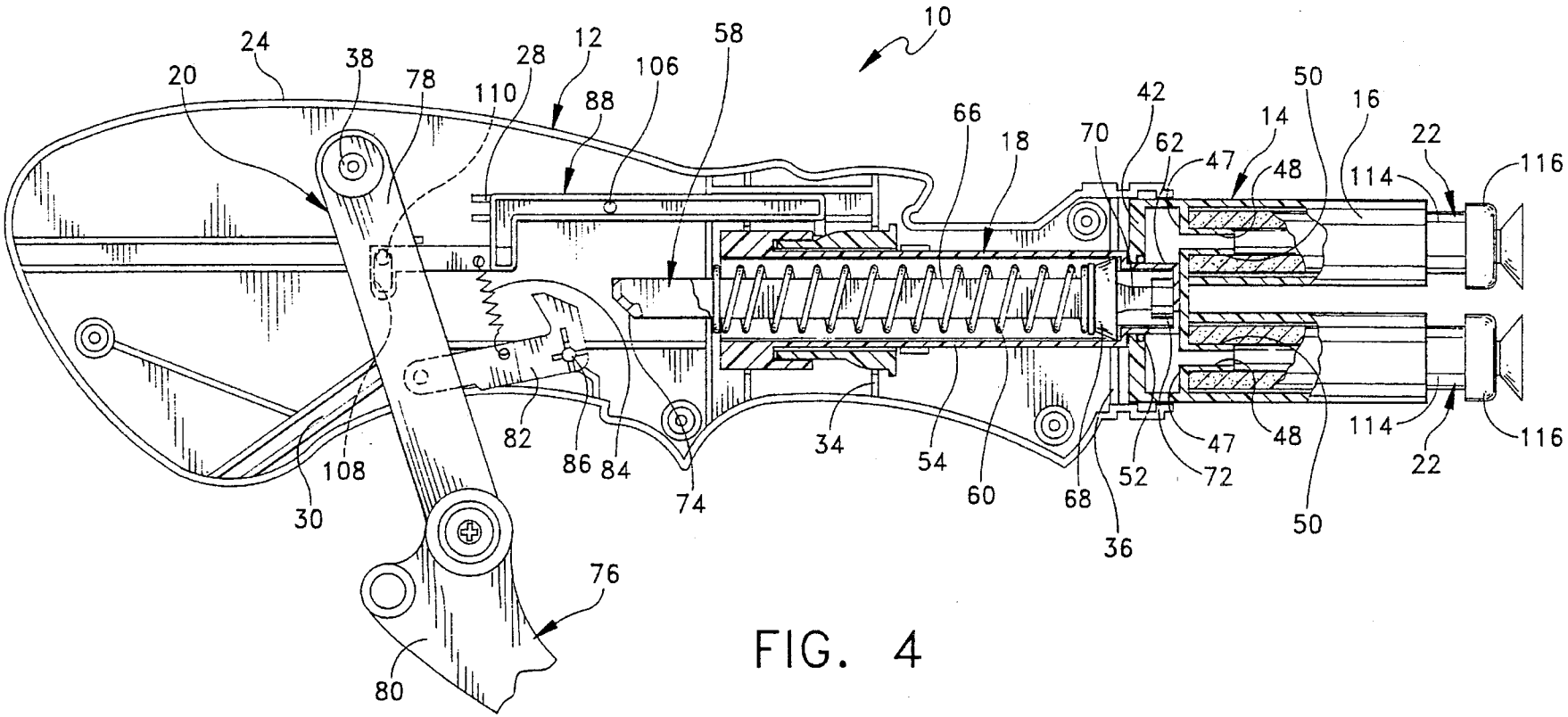
FIGS. 4–8 are similar views shown in partial section illustrating the sequential operation of the launcher.
Figure 5:
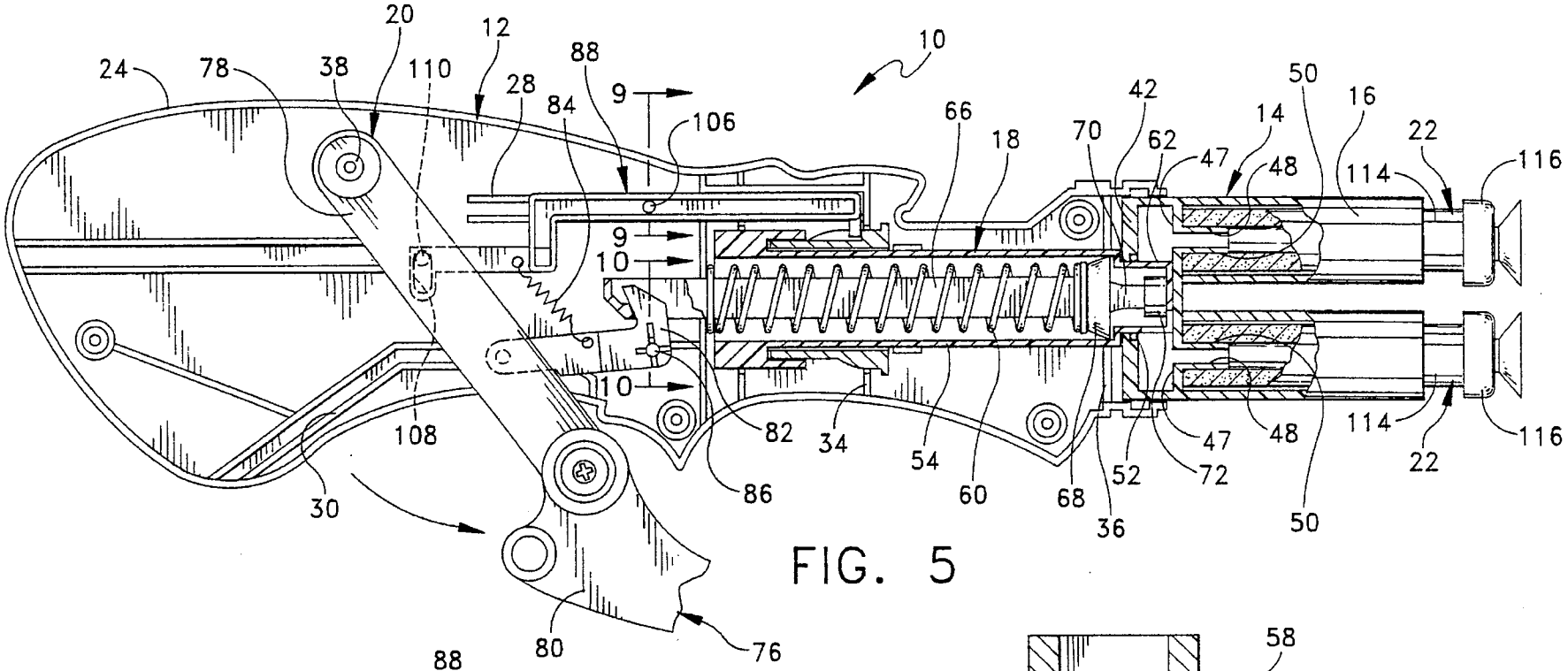
Figure 10:
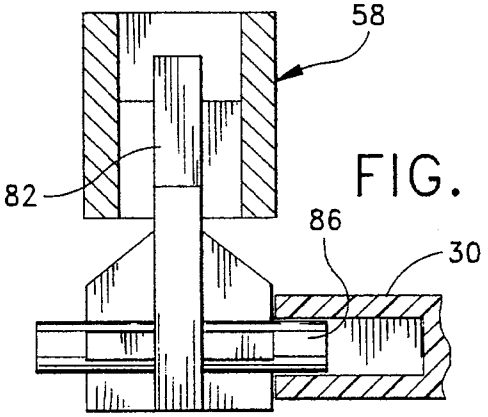
FIG. 10 is a sectional view taken along line 10—10 in FIG. 5.
Figure 9:
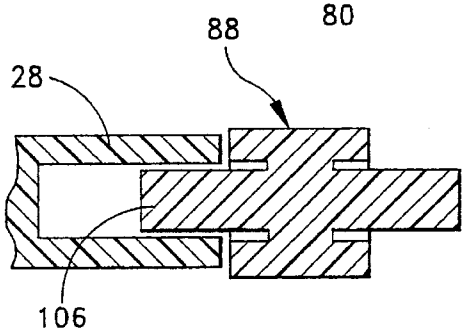
FIG. 9 is a sectional view taken along line 9—9 in FIG. 5.
Figure 6:
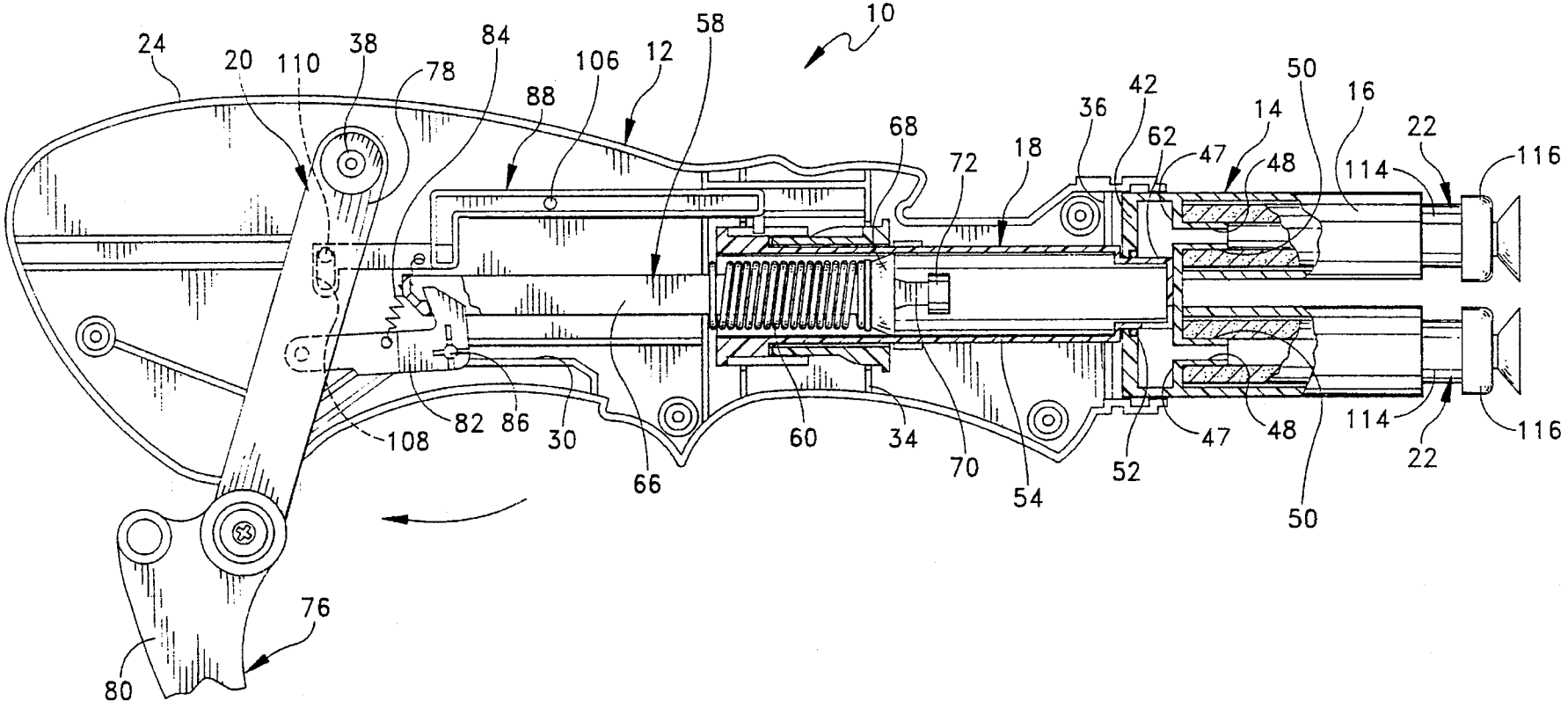
Figure 7:
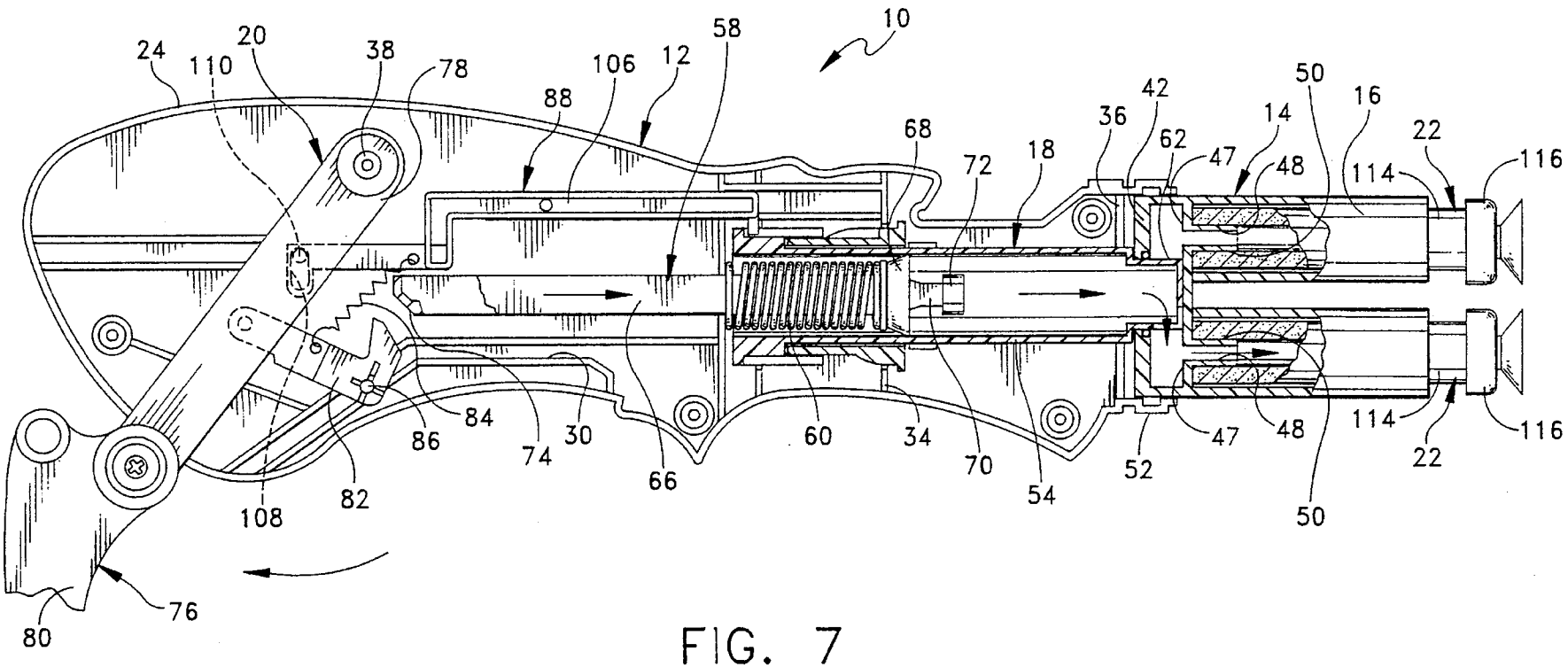
Figure 8:
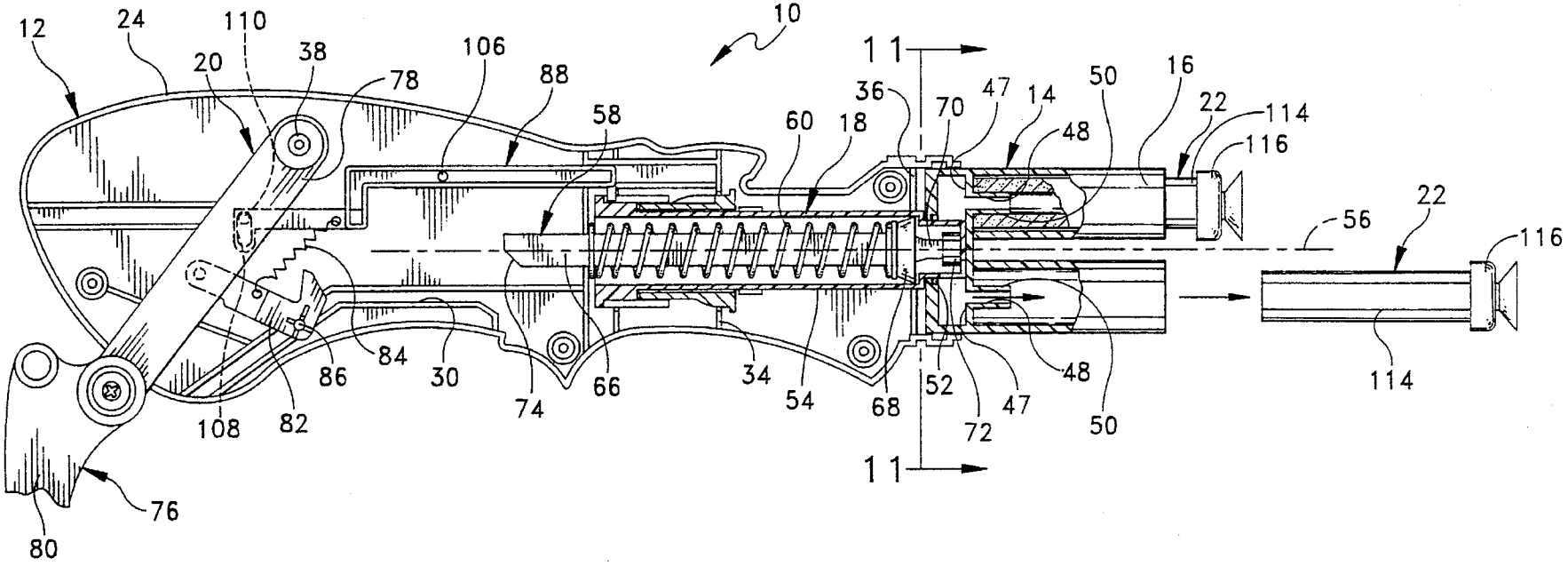
Figure 11:
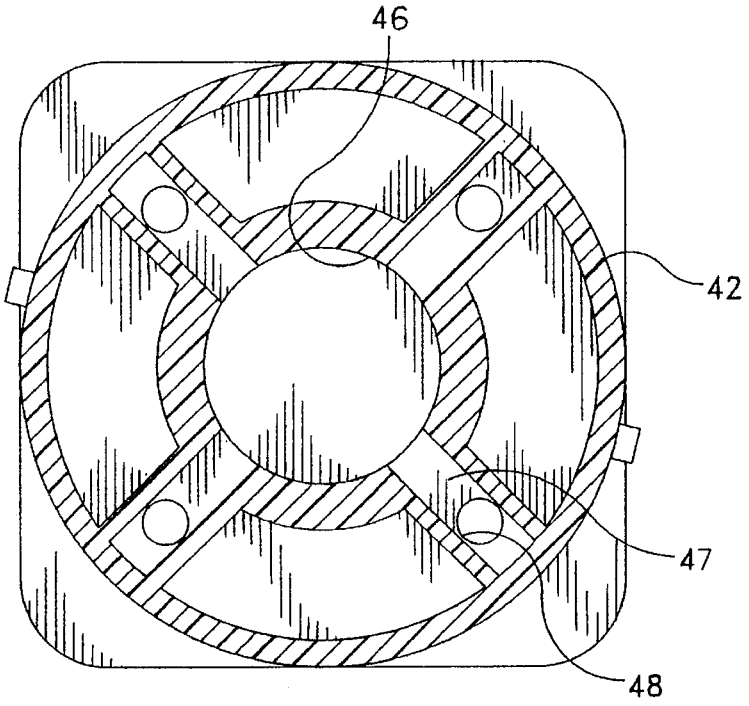
FIG. 11 is a sectional view taken along line 11—11 in FIG. 8.
Figure 12:
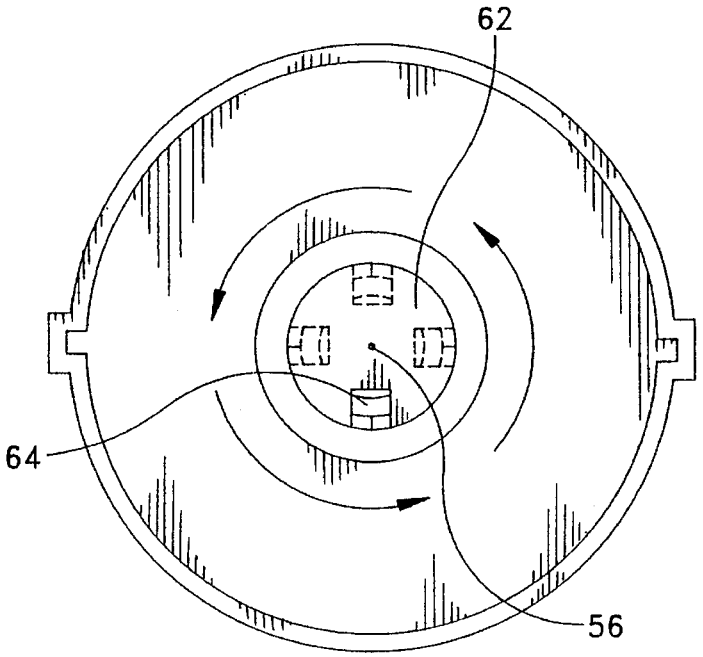
FIG. 12 is a front end view of the projectile launcher with the magazine removed.

Referring now to the drawings, the projectile launcher of the instant invention is illustrated in FIGS. 1–12 and generally indicated at 10 in FIGS. 1–8. The projectile launcher 10 comprises a body portion generally indicated at 12, a magazine assembly generally indicated at 14 having a plurality of launching chambers 16 thereon, a piston and cylinder assembly generally indicated at 18, and an operating mechanism generally indicated at 20. The projectile launcher 10 is adapted for launching projectiles 22 therefrom by manipulating the operating mechanism 20 to produce individual blasts of compressed air from the piston and cylinder assembly 18 and to also reorient the piston and cylinder assembly 18 so that sequential blasts of compressed air are delivered to sequential launching chambers 16 of the magazine assembly 14. Accordingly, the projectile launcher 10 is operative by rapidly manipulating the operating mechanism 20 to rapidly launch sequential projectiles 22 from the magazine 14.

The body portion 12 comprises left and fight housing sections 24 and 26, respectively, which are adapted for receiving and mounting the magazine 14, the piston and cylinder assembly 18, and the operating mechanism 20 thereon in the manner illustrated. More specifically, the left and right housing sections 24 and 26 include a plurality of internal bosses and guide walls which are operative for mounting and guiding various components of the piston and cylinder assembly 18 and the operating mechanism 20 during operation of the launcher 10. These guide walls include a pair of forward cam finger guide walls 28 which are cooperatively formed in both the left and right housing sections 24 and 26, and a pair of release latch guide walls 30, which are also cooperatively formed in the left and right housing sections 24 and 26. Also included in the interior of the body portion 12 is a piston and cylinder mounting frame assembly 34 and a front wall 36. The housing sections 24 and 26 each also include a circular mounting boss 38, and they are normally maintained in assembled relation with a plurality of screws 40.

The magazine assembly 14 includes a distribution manifold 42 of generally circular configuration, and it has a pair of alignment pins 44 thereon which are receivable in bayonet slots 45 in the body portion 12 for releasably securing the magazine 14 thereon. As illustrated most clearly in FIG. 11, the distribution manifold 42 includes a rearwardly opening centrally located circular recess 46 from which a plurality of distribution passages 47 radiate outwardly. The distribution passages 47 have forwardly extending apertures 48 therein which open forwardly into receiving tubes 50 which are located at the inner ends of the launching chambers 16. Accordingly, by selectively distributing individual blasts of compressed air into the distribution passages 47, the air is passed into the corresponding receiving tubes 50 for individually launching the projectiles 22 from the respective launching chambers 16 thereof. Also included in the magazine 14 is an O-ring seal 52 for achieving a seal between the distribution chamber 42 and the piston and cylinder assembly 18 as will hereinafter be more fully set forth.

The piston and cylinder assembly 18 comprises a cylinder 54 which is received in the body portion 12 so that it is rotatable about a longitudinal axis 56, a piston element 58 and a spring 60. The cylinder 54 includes a reduced forward end portion 62 having an outwardly facing air distribution outlet 64 therein. As illustrated most clearly in FIG. 12, the outlet 64 is spaced outwardly from the axis 56 so that it travels in a circular outwardly facing path as the cylinder element 54 is rotated in the body portion 12. The outlet 64 is positioned so that it is receivable in aligned relation with sequential air distribution passages 47 in the air distribution manifold 42 for distributing blasts of compressed air from the piston and cylinder assembly 18 to sequential launching chambers 16. Further, the reduced forward end portion 62 is received in sealed rotatable relation in the manifold 42 as a result of the O-ring 52. Accordingly, when a blast of compressed air is generated in the piston and cylinder assembly 18, substantially all of the air is distributed to the selected launching tube 16 with which the air distribution outlet 64 is in communication at any specified time.

The piston element 58 includes an elongated shaft portion 66 having a piston seal 68 thereon and it includes a forward stopper end portion 70 having a cushion element 72 thereon. The piston element 58 also includes a rearwardly facing cam surface 74 which provides a latching surface for receiving a latching element of the operating mechanism 20 in engagement with the rear end portion of the piston element 58 in order to reciprocate the piston element 58 in the cylinder element 54. The spring 60 is received on the piston element 58 for biasing it to a forward position in the cylinder 54.

The operating mechanism 20 is operative for both retracting the piston element 58 in the cylinder 54 against the force of the spring 60 so that the piston element 58 is eventually released in the cylinder element 54 and for rotating the cylinder element 54 to align the air distribution outlet 64 with the next sequential distribution passage 47 in the manifold 42. The operating mechanism 20 includes a two piece operating lever assembly 76 comprising a pivotally mounted upper internal lever portion 78 and a lower extension portion 80. The lower extension portion 80 is attached to the internal lever portion 78 so that it is movable between the operative position thereof illustrated in FIG. 1 and a forwardly collapsed position (not shown). The upper lever portion 78 is pivotally mounted on the boss 38, and a latch element 82 is pivotally attached to the upper lever portion 78. The latch element 82 is biased to an upward position with a spring 84, and it is adapted so that as the upper lever portion 78 is moved to the forward position, the latch portion 82 cams against the cam surface 74 to move the latch portion 82 into a position of latched engagement with the piston element 58. The latch element 82 also includes a pair of pins 86 which extend outwardly from opposite sides thereof for guiding the latch element 82 so that it follows the path defined by the guide walls 30. As a result, as the lever 78 is drawn rearwardly, the latch element 82 is eventually pivoted downwardly to disengage it from the piston 58. Consequently, the latch element 82 is operative for engaging the piston element 58 when the internal lever 78 is moved to a fully forward position, and as the lever 78 is pivoted rearwardly, the latch element 82 operates to draw the piston element 58 rearwardly in the cylinder element 54. However, when the latch element 82 is eventually pivoted downwardly against the force of the spring 84 by the guide walls 30, the piston element 58 is released from the latch element 82 so that the piston element 58 is propelled forwardly in the cylinder element 54 by the spring 60.

Also included in the operating mechanism 20 is a cam assembly generally indicated at 88 which is operative for rotating the cylinder 54 in stepped increments so that each time the piston element 58 is released in the cylinder 54, the air distribution outlet 64 is aligned with the next sequential distribution passage 47 in the air distribution manifold 42. The cam assembly 88 includes a cam ring 90 which is integrally formed in concentric relation on the rear portion of the cylinder 54. The cam element 90 includes a plurality of cam leaves 92 which are spaced outwardly from the outer wall of the cylinder 54, and an alignment wall 94 is provided between each of the cam leaves 92 and the adjacent section of the cylinder 54. Also included in the cam assembly 88 is a cam sleeve 96 having a plurality of cam leaves 98 thereon. The cam sleeve 96 further includes a tubular section 100 having rearwardly opening slots 102 therein which are received on the alignment walls 94 to nonrotatably position the cam sleeve 96 relative to the cam element 90. The cam sleeve 96 is positioned so that the cam leaves 98 are spaced from the leaves 92 and so that they cooperate therewith to define a zigzagging channel or slot which extends around the circumferential periphery of the piston and cylinder assembly 18. The cam assembly 88 further includes a cam arm 104 having a pair of drive pins 106 thereon which travel in the channel defined by the guide walls 28. The rear end of the cam arm 104 has an elongated aperture 108 formed therein which is received over a pin 110 on the lever arm 78. Accordingly, the cam arm 104 can travel rearwardly as the lever 78 is pivoted rearwardly without causing the rear end portion of the cam arm 104 to be shifted in a vertical direction. Formed on the forward end 7portion of the cam arm 104 is a cam finger 112 which travels in the channel defined by the leaves 92 and 98. The finger 112 is therefore operative for rotating the cylinder element 54 by a predetermined amount each time the internal lever arm 78 is pivoted forwardly for engaging the latch element 82 with the rear end of the piston element 58 and then pivoted rearwardly for releasing the piston element 58 to deliver a blast of compressed air to the magazine 14. More specifically, as the lever 78 is pivoted forwardly, the cam finger 112 engages the surface of one of the leaves 98 for rotating the cylinder 54 approximately one-eighth of a turn. As the lever 78 is then pivoted rearwardly for retracting the piston 58 in the cylinder 54, the finger 112 engages the adjacent leaf 92 for again rotating the cylinder an eighth of a turn in the same direction. The travel of the finger 112 and the configuration of the cam element 90 are adapted so that rotation of the cylinder 54 is completed before the latch element 82 is disengaged from the piston 58 so that the air distribution outlet 64 is aligned with the next sequential distribution passage 47 before the piston element 58 is released in the cylinder element 54. In this regard, it will be understood, however, that other embodiments which include cam assemblies of other configurations to accommodate magazines having different quantities of launching chambers 16 thereon are contemplated.

The projectiles 22 are of conventional construction and they preferably each include a generally cylindrical body portion 114 and a suction cup tip portion 116. Each of the body portions 114 has a rearwardly opening tubular recess formed therein which is adapted to be received over one of the receiving tubes 50, and each of the cylindrical portions is dimensioned to be received in one of the launching chambers 16 in a conventional manner. However, it will be understood that other embodiments of the projectile launcher of the instant invention which are adapted for launching other types of projectiles including spherical balls or the like are also contemplated.

Accordingly, for use and operation of the projectile launcher 10, a plurality of the projectiles 22 is assembled with the magazine 14 in the manner illustrated, and the operating mechanism 20 is operated by manipulating the handle 80 to pivot the lever 78 forwardly for engaging the latch element 82 with the piston element 58 and then drawing the handle 80 rearwardly to release the piston element 58. As the lever arm 78 is pivoted first forwardly and then rearwardly in this manner, the cam finger 112 operates to rotate the cylinder element 54 to align the air distribution outlet 64 with the next sequential air distribution passage 47. Finally, when the lever arm 78 is pivoted sufficiently rearwardly to disengage the latch element 82 from the piston element 58, the spring 60 propels the piston element 58 forwardly in the cylinder element 54 to produce a blast of compressed air which is distributed through the distribution outlet 64 into the distribution passage aligned therewith for launching the appropriate projectile 22 from the magazine 14. The operating mechanism 20 can then be repeatedly operated in a similar manner for rapidly launching all of the projectiles 22 from the magazine 14.

It is seen, therefore, that the instant invention provides an effective projectile launching device. The projectile launcher 10 is adapted to operate with a simple and convenient lever action, and the cam assembly 88 is effectively operative for rotating the cylinder element 54 in the launcher body 12 to align the air distribution outlet 64 with the next sequential distribution passage each time the operating mechanism 20 is operated. Accordingly, the launcher 10 can effectively utilize a relatively simple operating mechanism without requiring a separate mechanism to rotate or otherwise move the magazine 14 during a firing operation. Hence, it is seen that the projectile launcher 10 represents a significant advancement in the art relating to toy projectile launching apparatus which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A projectile launcher comprising a launcher body having a front end, a magazine on said launcher body adjacent said front end, said magazine including a plurality of forwardly directed launching chambers, each of said launching chambers including an air inlet and each being adapted for receiving a projectile thereon so that the projectile is launchable therefrom by delivering a blast of compressed air thereto through the respective air inlet thereof, said air inlets being substantially uniformly spaced in a substantially circular array on said magazine;

a piston and cylinder assembly in said body including a cylinder having a central axis, said cylinder being mounted in said body so that it is rotatable about said axis, and a piston reciprocally movable in said cylinder along said axis for producing blasts of compressed air, said cylinder including an air outlet which is radially spaced outwardly from said axis, said blasts of compressed air being individually discharged from said cylinder through said air outlet, said air outlet being positioned such that rotation of said cylinder in predetermined stepped increments causes said air outlet to be sequentially positioned in communication with sequential air inlets in said magazine; and operating means for reciprocating said piston in said cylinder to produce blasts of compressed air from said piston and cylinder assembly and for rotating said cylinder in said stepped increments so that said air outlet is positioned in communication with sequential air inlets during sequential blasts of compressed air.

2. In the projectile launcher of claim 1, said magazine being mounted in a stationary nonrotatable relation on said body.

3. In the projectile launcher of claim 1, said operating means including a rearwardly pivotable, manually operable lever for both reciprocating said piston and rotating said cylinder in stepped increments.

4. In the projectile launcher of claim 1, said operating means including cam slot means on said cylinder and a cam finger engaging said cam slot means for rotating said cylinder in said body.

5. In the projectile launcher of claim 4, said operating means further including a rearwardly pivotable manually operable lever for both reciprocating said piston and for operating said cam finger to engage said cam slot means to rotate said cylinder in said body.

6. A projectile launcher comprising a launcher body having a front end;

magazine means on said front end, said magazine means including a plurality of launching chambers for receiving projectiles thereon in a sequential array and being operative for individually sequentially launching said projectiles from sequential launching chambers in response to the delivery of individual blasts of compressed air to said magazine means;

piston and cylinder means in said body for delivering individual blasts of compressed air to said magazine means for launching said projectiles therefrom, said piston and cylinder means being rotatable about an axis for sequentially positioning said piston and cylinder means in communication with sequential launching chambers of said magazine means for launching projectiles therefrom; and operating means for operating said piston and cylinder means to produce blasts of compressed air therefrom and to rotate said piston and cylinder means so that said piston and cylinder means is positioned in communication with sequential launching chambers during sequential blasts of compressed air.

* * * * *